US007649319B2

(12) United States Patent
Matsumoto et al.

(10) Patent No.: US 7,649,319 B2
(45) Date of Patent: Jan. 19, 2010

(54) ULTRA-HIGH PRESSURE MERCURY LAMP

(75) Inventors: Keiichi Matsumoto, Himeji (JP); Shoichi Terada, Himeji (JP); Tetsu Okamoto, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 346 days.

(21) Appl. No.: 11/421,943

(22) Filed: Jun. 2, 2006

(65) Prior Publication Data

US 2006/0273722 A1 Dec. 7, 2006

(30) Foreign Application Priority Data

Jun. 3, 2005 (JP) ..... 2005-164035

(51) Int. Cl.
*H01J 17/04* (2006.01)

(52) U.S. Cl. ..... 313/631; 315/49

(58) Field of Classification Search ..... 313/631–633; 315/49

See application file for complete search history.

(56) References Cited

U.S. PATENT DOCUMENTS

| | | | | |
|---|---|---|---|---|
| 4,574,219 | A * | 3/1986 | Davenport et al. | 315/49 |
| 5,107,178 | A | 4/1992 | Ohyama et al. | |
| 5,109,181 | A | 4/1992 | Fischer et al. | |
| 5,497,049 | A | 3/1996 | Fischer | |
| 6,046,544 | A * | 4/2000 | Daemen et al. | 313/633 |
| 6,483,240 | B2 | 11/2002 | O'Hare et al. | |
| 6,614,187 | B1 | 9/2003 | Kanzaki et al. | |
| 2004/0155588 | A1 | 8/2004 | Tukamoto et al. | |
| 2006/0055329 | A1 | 3/2006 | Yamashita et al. | |

FOREIGN PATENT DOCUMENTS

| | | | |
|---|---|---|---|
| EP | 0647964 | A1 | 4/1995 |
| EP | 0917180 | A1 | 5/1999 |
| JP | 01050359 | A | 2/1989 |
| JP | 7 226187 | A | 8/1995 |
| JP | 9 76092 | A | 3/1997 |
| JP | 9 111387 | A | 4/1997 |
| JP | 9 111388 | A | 4/1997 |
| JP | 1154086 | A | 2/1999 |
| JP | 2000 57995 | A | 2/2000 |
| JP | 2000 149868 | A | 5/2000 |
| JP | 2001 351573 | A | 12/2001 |
| JP | 2002 56807 | A | 2/2002 |
| WO | 03075310 | A1 | 9/2003 |

* cited by examiner

*Primary Examiner*—Nimeshkumar D Patel
*Assistant Examiner*—Mary Ellen Bowman
(74) *Attorney, Agent, or Firm*—David S. Safran; Roberts Mlotkowski Safran & Cole, P.C.

(57) ABSTRACT

An ultra-high pressure mercury lamp in which the tungsten comprising the electrodes is prevented from spraying during starting and operation, and blackening on the inside wall of the arc tube is prevented is achieved in that at least one of the electrodes has an axial part which is made essentially of tungsten and a starting part which is made essentially of tungsten, at least one of the axial part and of the starting part containing an electron emission material with a smaller work function than tungsten such that the value of S/A in $mm^2/\%$ by weight is in the range $1 \leqq S/A \leqq 1\times10^4$, S in $mm^2$ designating the surface area of the part of the electrode projecting into the arc tube containing the electron emission material and A in % by weight indicating the concentration of the electron emission material in this part.

10 Claims, 3 Drawing Sheets

ULTRA-HIGH PRESSURE MERCURY LAMP

BACKGROUND OF THE INVENTION

1. Field of the Invention

The invention relates to a discharge lamp which is used for a liquid crystal display device and for a projector device, such as a DLP (digital light processor) or the like using a DMD (digital micro-mirror device). The invention relates especially to an ultra-high pressure mercury lamp in which the arc tube is filled with at least 0.15 mg/mm$^3$ of mercury and in which the mercury vapor pressure during operation is at least 150 atm.

2. Description of the Prior Art

In a projector device of the projection type which includes a liquid crystal projector, DLP or the like using a DMD, there is a need for uniform illumination of images onto a rectangular screen, moreover with adequate color rendering. Therefore, the light source is a metal halide lamp filled with mercury and a metal halide. Recently, these metal halide lamps have been becoming smaller and smaller, and more and more often point light sources are being produced. In practice, they are used with extremely small distances between the electrodes.

Against this background, lamps with an extremely high mercury vapor pressure in operation, for example, with at least 150 atm, have recently been suggested instead of metal halide lamps. This increase of the mercury vapor pressure is designed to reduce broadening of the arc (the arc is compressed), and at the same time, to greatly increase the light intensity. Such an ultra-high pressure mercury lamp is disclosed, for example, in Japanese patent application publication JP-A-HEI 2-148561 which corresponds to U.S. Pat. No. 5,109,181 and in Japanese patent application JP-A-HEI 6-52830 which corresponds to U.S. Pat. No. 5,497,049.

Such an ultra-high pressure mercury lamp often has the disadvantage that blackening of the inside wall of the arc tube reduces the light transmittance. This is a result of the high operating temperature of the electrodes and frequent spraying of the tungsten electrode material during operation causing tungsten to be deposited on the inside wall of the bulb.

Therefore, the above described publications describe that the arc tube, which has a spherical light emitting part in its middle area, is filled with a given amount of halogen gas, and that blackening in the arc tube is prevented by carrying out the halogen cycle.

On the other hand, in the above described ultra-high pressure mercury lamp, there are also many cases in which the tungsten comprising the electrodes sprays during start-up. It can be imagined that this is caused by the following.

Normal operation of the ultra-high pressure mercury lamp takes place such that, at the start of operation, a glow discharge is formed in which the cathode constitutes the starting point, that the discharge starting point passes to the cathode tip when a high temperature state of the electrodes is reached by a glow discharge, and that it passes into rated operation due to the hot arc discharge.

However, since in this glow discharge the starting voltage (the voltage necessary for starting) is high, the tungsten sprays easily due to the fact that vigorous ion sputtering and thermal shocks are applied to the electrodes. This spraying of the tungsten leads directly to blackening of the arc tube, since the halogen cycle is inactive during starting. Therefore, spraying of the tungsten is regarded as more disadvantageous in start-up than in operation.

SUMMARY OF THE INVENTION

A primary object of the present invention is, therefore, to devise an ultra-high pressure mercury lamp with a long service life in which the tungsten of the electrodes is prevented from spraying during starting as well as during operation, and that blackening of the inside wall of the arc tube is prevented.

To prevent the above described spraying of the tungsten, it is effective for the electrodes to contain an electron emission material with a lower (electron) work function than that of the tungsten of the electrodes, for the electron emission from the electrodes to be simplified by reducing the electrode work function, and for the starting voltage to be reduced. This measure reduces the starting voltage necessary for producing the above described glow discharge, by which the ion sputtering and the thermal shocks which were described above and which are applied to the electrodes are suppressed. Therefore, spraying of the tungsten during starting is prevented.

The inventors stayed not only with the measure that simply the electrodes contain an electron emission material with lower work function than that of the tungsten of the electrodes, but conducted farther tests and ascertained the following:

In the case in which the electrodes contain the above described electron emission material, the relation between the area S (mm$^2$) of the parts of the electrode projecting into the arc tube containing the above described electron emission material, and the concentration A (% by weight) of the electron emission material in these parts has a great effect on the spraying of the tungsten. Specifically, in the case of a small area S of the electrode projecting into the arc tube, a high concentration of the electron emission material is desired in order to prevent spraying of the tungsten. On the other hand, in the case of a large area S of the electrode projecting into the arc tube, a small concentration of the electron emission material is desired in order to prevent spraying of the tungsten, and moreover, to prevent excess release of the electron emission material into the arc tube. The inventors have established specifically that by optimum fixing of the relation between the area S of the part of the electrode projecting into the arc tube, which part contains the electron emission material, and the concentration A of the electron emission material, blackening of the inside wall of the arc tube can be reliably prevented.

The above described object is achieved according to a first aspect of the invention which was established based on the above described finding for an ultra-high pressure mercury lamp in which there are a pair of opposed electrodes in the arc tube and the arc tube is filled with at least 0.15 mg/mm$^3$ of mercury, in that at least one of the electrodes has an axial part and a starting part which are made of tungsten, that the above described axial part and/or the above described starting part has/have an electron emission material with a smaller work function than that of tungsten and that the relation $1 \leqq S/A$ (mm$^2$/% by weight)$\leqq 1\times10^4$ is satisfied, where S (mm$^2$) is the surface area of the part of the electrode projecting into the above described arc tube containing the electron emission material and A is the concentration (% by weight) of the electron emission material in this part.

The object is also achieved according to another aspect of the invention in that only the starting part of the electrode formed of the axial part and the starting part contains the electrode emission material, and that the relation $1 \leqq S/A$ (mm$^2$/wt. %)$\leqq 1\times10^4$ is satisfied where S (mm$^2$) is the surface area of the part of the starting part containing the electron emission material and A is the concentration (wt. %) of the electron emission material in this part.

The technical meaning of this measure is described below.

The following measures can be taken against the disadvantage resulting from spraying of the tungsten off the electrodes.

The above described electron emission material is used.

The relation between the surface area of the part of the electrodes projecting into the arc tube containing the electron emission material, and the concentration of the electron emission material in this part is established to be optimum.

According to another aspect of the invention, in addition to these measures, the glow discharge which becomes the main factor of spraying of the tungsten is considered, and from the standpoint of shortening the duration of the glow discharge and from the standpoint of producing the glow discharge at the points which are remote from the inside wall of the arc tube, the object of preventing the spraying of the tungsten is achieved.

Furthermore, the object is achieved according to a farther aspect of the invention in that at least one of the above electrodes has a part with a larger diameter and a tungsten starting aid part, that the above described part with a larger diameter and/or the above described starting part has/have an electron emission material with a smaller work function than that of tungsten and that the relation $1 \leqq S/A$ ($mm^2$/wt. %)$\leqq 1\times10^4$ is satisfied, where S ($mm^2$) is the surface area of the part of the electrode projecting into the above described arc tube containing the electron emission material and A (wt. %) is the concentration of the electron emission material in this part.

The object is furthermore achieved according to a farther aspect of the invention in that at least one of the above described electrodes has a part with a larger diameter and a starting part made of tungsten, that only the above described starting part contains the electron emission material, and that the relation $1 \leqq S/A$ ($mm^2$/% by weight)$\leqq 1\times10^4$ is satisfied where S ($mm^2$) is the surface area of the part of the electrode projecting into the above described arc tube containing the electron emission material and A (wt. %) is the concentration of the electron emission material in this part.

The inventors conducted further tests and ascertained that, when the above described electron emission material contains at least one of the elements yttrium, lanthanum, cerium, barium, strontium, hafnium and zirconium, these elements and the halogen combine with one another with difficulty. One development of the invention was devised based on this finding. According to it, the object is achieved in that the above described electron emission material contains at least one of the elements yttrium, lanthanum, cerium, barium, strontium, hafnium and zirconium.

According to another development of the invention, the object is achieved in that the above described starting part is coil-shaped, in order to further shorten the duration of the glow discharge.

Action of the Invention

Spraying of tungsten can be prevented, and moreover, the adverse effect on the halogen cycle as a result of emission of the electron emission material into the arc tube can be suppressed by the ultra-high pressure mercury lamp according to the first aspect of the invention by optimum establishment of the relation between the area S of the part of the electrode projecting into the arc tube containing the electron emission material, and the concentration A of the electron emission material in this part.

The glow discharge can be concentrated on the starting part and the temperature of the starting part can be increased more rapidly by the ultra-high pressure mercury lamp according to the second aspect of the invention by the measure that, between the electrode of the axial part and the starting aid part, only the starting part contains the electron emission material, since the work function of the starting part is lower than the work function of the other parts. Therefore, the length of the glow discharge can be shortened and a more rapid transition to a hot arc discharge can be carried out.

Furthermore, in the case of spraying of the tungsten, since the distance from the inside wall of the arc tube is increased by the starting point of the glow discharge being located on the starting aid part, tungsten adhering on the inside wall of the arc tube can be suppressed.

The same effects as in the first and second aspect can also be obtained by the ultra-high pressure mercury lamp according to the third and fourth aspect of the invention in a lamp of the alternating operation type.

The ultra-high pressure mercury lamp according to the fourth aspect of the invention reduces the effect on the halogen cycle by the electrodes projecting into the arc tube containing an electron emission material which contains at least one of the elements yttrium, lanthanum, cerium, barium, strontium, hafnium and zirconium.

The ultra-high pressure mercury lamp according to the fifth aspect of the invention can shift the starting part in an extremely short time into the high temperature state because the heat capacity of the starting part is reduced by the starting part having a coil shape. Furthermore, the coil shape enables simple installation on the axial part.

The invention is further described below with reference to the accompanying drawings.

DETAILED DESCRIPTION OF THE INVENTION

Figure 1:
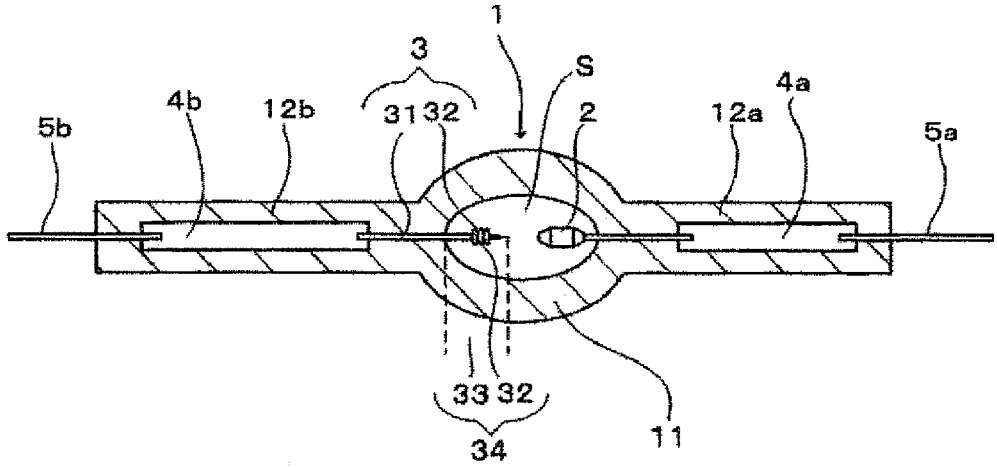
FIG. 1 is a schematic longitudinal cross-sectional view of a first embodiment of the ultra-high pressure mercury lamp in accordance with the invention.

FIG. 1 is a cross section of an ultra-high pressure mercury lamp in accordance with the invention that has an arc tube 1, an anode 2 and a cathode 3, metal foils 4 and outer leads 5. It is operated using a direct current.

The arc tube 1 is made, for example, of silica glass and has a an oval light emitting part 11 located in the middle and hermetically sealed portions 12*a*, 12*b* connected to respective two ends of the light emitting part 11. The arc tube is filled with mercury as the emission substance, a rare gas as the buffer gas and halogen gas for executing the halogen cycle.

The amount of mercury added is at least 0.15 mg/$mm^3$, for example, 0.2 mg/$mm^3$. The mercury vapor pressure during operation is thus at least 150 atm. The rare gas is, for example, argon gas, and the amount added is, for example, 13 kPa. The halogen gas is, for example, bromine, and it is added in an amount in the range from $2.0\times10^{-4}$ μmol/$mm^3$ to $7.0\times10^{-3}$ μmol/$mm^3$, for example, $3.0\times10^{-4}$ μmol/$mm^3$.

For an arc tube 1, the maximum outside diameter of the light emitting part 11 is 12 mm, the total length of the light emitting part 11 is 10.8 mm, the maximum outside diameter of the hermetically sealed portions 12*a*, 12*b* is 7.6 mm, the total length of the hermetically sealed portion 12*b* is 30 mm, the total length of the hermetically sealed portion 12*a* is 22 mm, the total length is 62 mm and the inside volume is 154 $mm^3$.

The anode 2 and the cathode 3 are located coaxially opposite each other within the arc tube 1. The anode 2 is installed partially into the hermetically sealed portion 12*a*, and its base part is connected to the metal foil 4*a*. The cathode 3 has an axial part 31 and a starting part 32 which is connected in the vicinity of the tip of the axial part 31. The axial part 31 is partially installed in the hermetically sealed portion 12*b*, and its base part is connected to a metal foil 4*b*. A cavity of at most 300 μm is formed between the axial part 31 and the hermetically sealed portion 12*b* with consideration of a large difference between the coefficient of thermal expansion of the tungsten comprising the axial part 31 and the coefficient of thermal expansion of the silica glass comprising the hermetically sealed portion 12*b*. The starting part 32 projects overall into the space S within the arc tube 1. The metal foils 4*a*, 4*b* are formed, for example, of molybdenum and are installed in a respective one of the hermetically sealed portions 12*a*, 12*b*. The outer leads 5*a*, 5*b* are made, for example, of molybdenum and their tip areas are connected to one of the metal foils 4*a*, 4*b*. Their base parts project to the outside from the hermetically sealed portions 12*a*, 12*b*.

The anode 2 is made of tungsten. Here, the total length is 13.5 mm, the maximum outside diameter is 3.0 mm and the surface area is 62 $mm^2$.

The cathode 3 is made of tungsten, and moreover, contains an electron emission material comprised of at least one of the elements yttrium, lanthanum, cerium, barium, strontium, hafnium and zirconium.

The reason why the volume of the anode 2 is greater than the cathode 3 is that, in the ultra-high pressure mere lamp of the invention, the thermal conditions within the arc tube 1 are extremely strict and the anode 2 constitutes an area in which the electron shocks from the cathode 3 are captured.

In the axial part 31, the total length is 11 mm and the maximum outside diameter is 1.3 mm. In the starting part 32, a wire material of tungsten with a wire diameter of 0.1 mm to 1.0 mm in the form of a coil with an outside diameter of 0.4 mm to 5.0 mm and a total length of 0.2 mm to 5.0 mm is formed and is installed along the lengthwise direction of the axial part 31 in the vicinity of the tip area of the axial part 31.

The coil shape of the starting part 32 simplifies installation in the axial part 31. Furthermore, a prompt transition from the glow discharge into the arc discharge can be carried out because the gap between the pitches of the coil often become the starting point of the discharge and heating easily takes place due to the coil shape. In rated operation, the starting part 32, because of its coil shape, causes heat emission due the effect of asperities and due to the heat capacity.

First Embodiment

One part (also called the projecting part 34) which is defined by (part 33+starting part 32) contains an electron emission material of yttrium or lanthanum, the part 33 belonging to the axial part 31 projecting into the light emitting part 11 and also being called the projecting axial part. In this way, the work function for the projecting part 34 is 2.0 eV to 3.3 eV. It is smaller compared to the work function (4.5 eV) in the case of an electrode 3 made solely of tungsten.

Furthermore, the electron emission material need not always be contained in the entire projection part 34, but only in a part of the projecting area 34. This means the area containing the electron emission material can be the following:

the entire projecting axial part 33 or only a part thereof;

part of the projecting axial part 33 and the entire starting part 32;

the entire projecting axial part 33 and a part of the starting part;

part of the projecting axial part 33 and part of the starting part 32 or the entire starting part 32 described below or only part thereof.

In this case, the surface area of the part containing the electron emission material is S and the concentration of the electron emission material in this part is A.

Second Exemplary Embodiment

The ultra-high pressure mercury lamp according a second version of the invention is characterized in that of the cathode 3 only the starting part 32 contains an electron emission material of yttrium or lanthanum and the work function in the starting part 32 is smaller than in the axial part 31. The other arrangement is identical to the ultra-high pressure mercury lamp according to the first version.

Third Exemplary Embodiment

Figure 2:
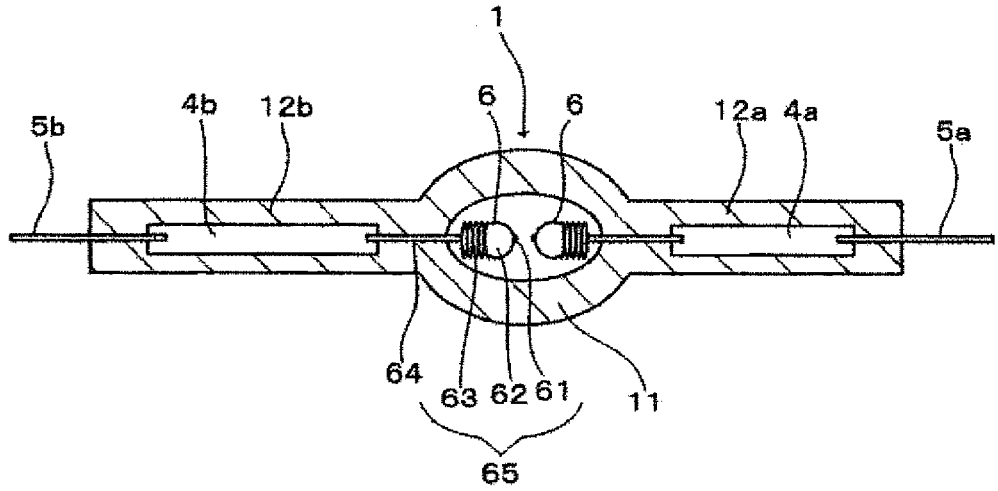
FIG. 2 is a schematic longitudinal cross-sectional view of another embodiment of the ultra-high pressure mercury lamp in accordance with the invention.

In the above described versions an ultra-high pressure mercury lamp of the direct current operation type was described. However, the invention can also be used for an ultra-high pressure mercury lamp of the alternating current operation type. FIG. 2 is a cross section of a third version of a ultra-high pressure mercury lamp in accordance with the invention of the alternating current operation type in which the same parts as in FIG. 1 or the parts corresponding to those of FIG. 1 are provided with the same reference numbers as ire FIG. 1.

As is shown in FIG. 2, the electrode 6 is comprised of a projection 61, a part with a larger diameter 62, a starting part 63 and an axial part 64. Electrodes 6 with essentially the same shapes are arranged coaxially opposite each other in light emitting part 11. From the electrode 6, the projection 61 the part 62 with he larger diameter and the starting part 63 project into the light emitting part 11.

The projection 61 is formed by the tip of the axial part 64 and is equivalent to the outside diameter of the axial part 64 or is somewhat larger or smaller than the outside diameter of the axial part 64 due to melting. This means that the projection 61 arises and grows, not by lamp operation, but is formed by the tip surface of the axial part 64 from the start.

The part 62 with a larger diameter is formed by melting proceeding from the state in which, for example, wire-like tungsten is wound in the manner of a coil. Because it is formed in lumps, a high heat capacity can be obtained. The part 62 with a larger diameter is especially critical due to the extremely strict thermal conditions within the light emitting part 11 in the ultra-high pressure mercury lamp of the invention.

From the starting part 63, the front part melts proceeding from the state in which likewise wire-like tungsten is wound in the manner of a coil, by which, from the remaining coil part, the part with a larger diameter 62 is formed. During starting, due to the coil shape of the starting part 63, a rapid transition from a glow discharge into an arc discharge can take place because the gap between the pitches of the coil often becomes the starting point of the discharge and because heating easily takes place due to the coil shape. In rated operation, the starting part 63, because of its coil shape, causes heat emission due the effect of the asperities and due to the heat capacity.

The projection 61, the part with a larger diameter 62, the starting part 63 and the axial part 64 consist of tungsten and project into the light emitting part 11. The part which consists of the projection 61, the part with a larger diameter 62, and the starting part 63 and which together are also called the projecting part 65 hereinafter, contains an electron emission material of at least one of the elements yttrium, lanthanum, cerium, barium, strontium, hafnium and zirconium.

In an ultra-high pressure mercury lamp according to the third embodiment of the invention, the lamp service life can also be prolonged when the numerical value in the above described comparison expression S/A is within the range from 1 to $10^4$ ($mm^2$/% by weight), as is also the case in the ultra-high pressure mercury lamp according to the first and second versions.

Furthermore, the electron emission material need not always be contained in the entire projecting part 65 as in the first version, but only in part of the projecting part 65. In this case, the lamp service life can be prolonged when the ratio S/A of the surface area S of the part containing the electron emission material from the projecting part 65 to the concentration A of the electron emission material in this part lies within the above described range of numerical values.

EXPERIMENTAL EXAMPLE

A test is described below which was devised for confirmation of the action of the invention in ultra-high pressure mercury lamps according to the first or third version of the invention.

According to the arrangement shown in FIG. 1 and according to the specification described below, 48 ultra-high pressure mercury lamps according to the exemplary embodiment were produced, in 24 lamps, one of the electrodes contained yttrium and in the other 24 lamps one of the electrodes contained lanthanum.

The arc tube 1 was made of silica glass. Here, the maximum outside diameter is 12 mm, the total length is 62 mm, the inside volume of the light emitting part 11 is 154 $mm^3$, the amount of mercury added is 0.2 $mg/mm^3$, the amount of argon added is 13 kPa, and the amount of bromine added is $3.0\times10^{-4}$ $\mu mol/mm^3$. For the axial part 31 and the starting part 32, the tungsten contains yttrium or lanthanum as the electron emission material. The specification and the value of S/A are described below using Table 1.

The effects on lamp service life (test 1) were studied, in which the process was repeated 1000 times, in which these 48 ultra-high pressure mercury lamps were each operated for 20 minutes and then were turned off for 20 minutes, and in the case (test 2) in which these 48 lamps were operated without interruption for 1000 hours. The lamp input wattage was 300 W both in test 1 and test 2. Table 1 shows the results.

| Exemplary embodiment | S/A [$mm^2$/% by wt.] | S [$mm^2$] S1 | S [$mm^2$] S2 | A [% by weight] S1 | A [% by weight] S2 | Electron Emission Material is $Y_2O_3$ Test 1 | Electron Emission Material is $Y_2O_3$ Test 2 | Electron Emission Material is $La_2O_3$ Test 1 | Electron Emission Material is $La_2O_3$ Test 2 |
|---|---|---|---|---|---|---|---|---|---|
| 1 | $2\times10^{-1}$ | 7.5 | 4 | 0 | 20 | X | ○ | X | ○ |
| 2 | $4\times10^{-1}$ | 7.5 | 4 | 0 | 10 | Δ | ○ | X | ○ |
| 3 | $1\times10^{0}$ | 7.5 | 4 | 0 | 4 | ¤ | ¤ | ¤ | ¤ |
| 4 | $2.9\times10^{0}$ | 7.5 | 4 | 4 | 4 | ○ | ○ | ○ | ○ |
| 5 | $1.9\times10^{1}$ | 10 | 9.5 | 0 | 0.5 | ¤ | ¤ | ¤ | ¤ |
| 6 | $2.3\times10^{1}$ | 18 | 11.5 | 0 | 0.5 | ¤ | ¤ | ¤ | ¤ |
| 7 | $2.6\times10^{1}$ | 8 | 13 | 0 | 0.5 | ¤ | ¤ | ¤ | ¤ |
| 8 | $3.9\times10^{1}$ | 10 | 9.5 | 0.5 | 0.5 | ○ | ○ | ○ | ○ |
| 9 | $4.2\times10^{1}$ | 8 | 13 | 0.5 | 0.5 | ○ | ○ | ○ | ○ |
| 10 | $5.6\times10^{1}$ | 19 | 28 | 0 | 0.5 | ¤ | ¤ | ¤ | ¤ |
| 11 | $5.9\times10^{1}$ | 18 | 11.5 | 0.5 | 0.5 | ○ | ○ | ○ | ○ |
| 12 | $9.4\times10^{1}$ | 19 | 28 | 0.5 | 0.5 | ○ | ○ | ○ | ○ |
| 13 | $9.5\times10^{2}$ | 10 | 9.5 | 0 | 0.01 | ¤ | ¤ | ¤ | ¤ |
| 14 | $1.15\times10^{3}$ | 18 | 11.5 | 0 | 0.01 | ¤ | ¤ | ¤ | ¤ |
| 15 | $1.3\times10^{3}$ | 8 | 13 | 0 | 0.01 | ¤ | ¤ | ¤ | ¤ |
| 16 | $1.95\times10^{3}$ | 10 | 9.5 | 0.01 | 0.01 | ○ | ○ | ○ | ○ |
| 17 | $2.1\times10^{3}$ | 8 | 13 | 0.01 | 0.01 | ○ | ○ | ○ | ○ |
| 18 | $2.8\times10^{3}$ | 19 | 28 | 0 | 0.01 | ¤ | ¤ | ¤ | ¤ |
| 19 | $3.0\times10^{3}$ | 18 | 11.5 | 0.01 | 0.01 | ○ | ○ | ○ | ○ |
| 20 | $4.0\times10^{3}$ | 30 | 20 | 0 | 0.005 | ¤ | ¤ | ¤ | ¤ |
| 21 | $4.7\times10^{3}$ | 19 | 28 | 0.01 | 0.01 | ○ | ○ | ○ | ○ |
| 22 | $1\times10^{4}$ | 30 | 20 | 0.005 | 0.005 | ○ | ○ | ○ | ○ |
| 23 | $5\times10^{4}$ | 30 | 20 | 0.001 | 0.001 | ○ | Δ | ○ | X |
| 24 | $1\times10^{5}$ | 30 | 20 | 0.0005 | 0.0005 | ○ | X | ○ | X |

In Table 1 the evaluations are labeled ¤, ○, Δ, x. Tungsten electrodes which do not contain the above described electron emission material were used as the reference. Cases are labeled—+¤ in which the service life compared to these electrodes was greatly prolonged. Cases were labeled ○ in which the service life compared to these electrodes was prolonged; cases were labeled Δ in which the service life was equal to the service life of these electrodes, and finally cases were labeled × in which the service life was shortened.

In Table 1 exemplary embodiments 1, 2, 3, 4, 5, 6, 8, 11, 13, 14, 16, 19, 20, 22, 23 and 24 relate to the lamp of the direct current operating type shown in FIG. 1, while exemplary embodiments 7, 9, 10, 12, 15, 17, 18 and 21 relate to the lamp of the alternating current operating type shown in FIG. 2.

Figure 3:
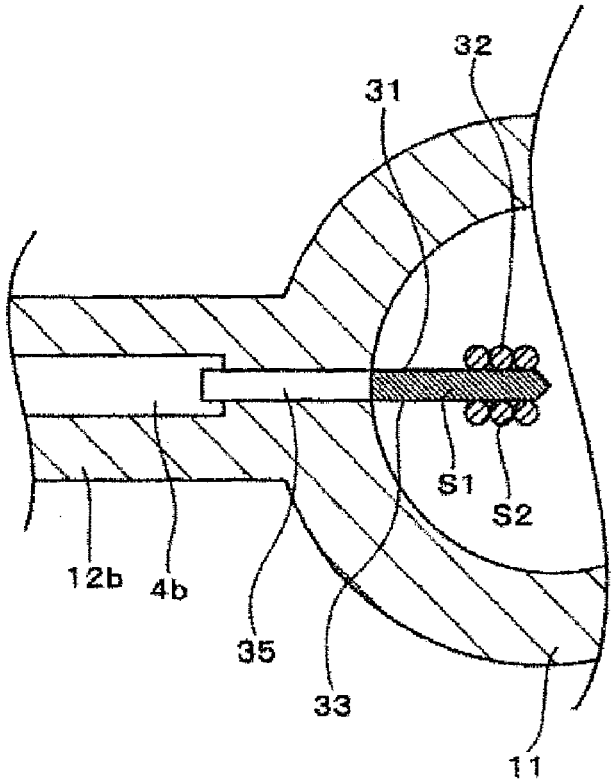
FIGS. 3(*a*) & 3(*b*) each show an enlarged schematic view of important parts of the lamp in FIG. 1, and FIGS. 4 (*a*) & 4(*b*) each show an enlarged schematic view of important parts of the lamp in FIG. 2.
Figure 3:
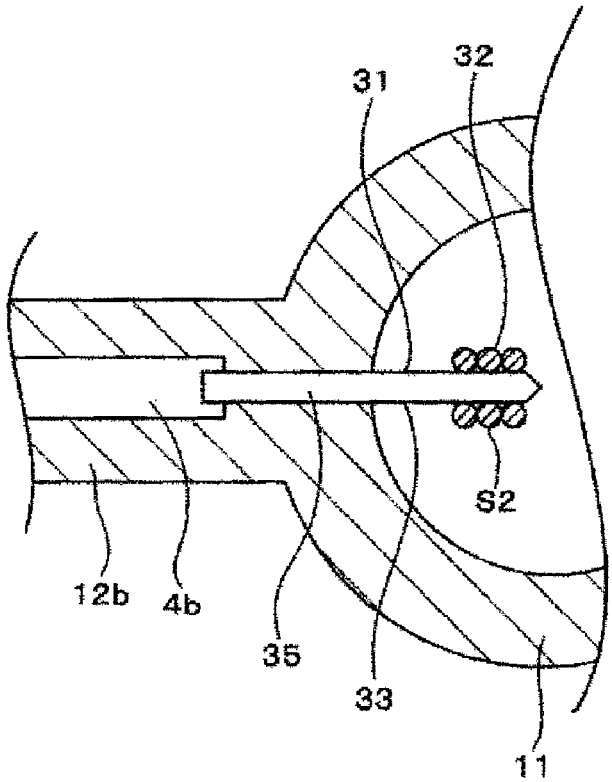
Figure 4:
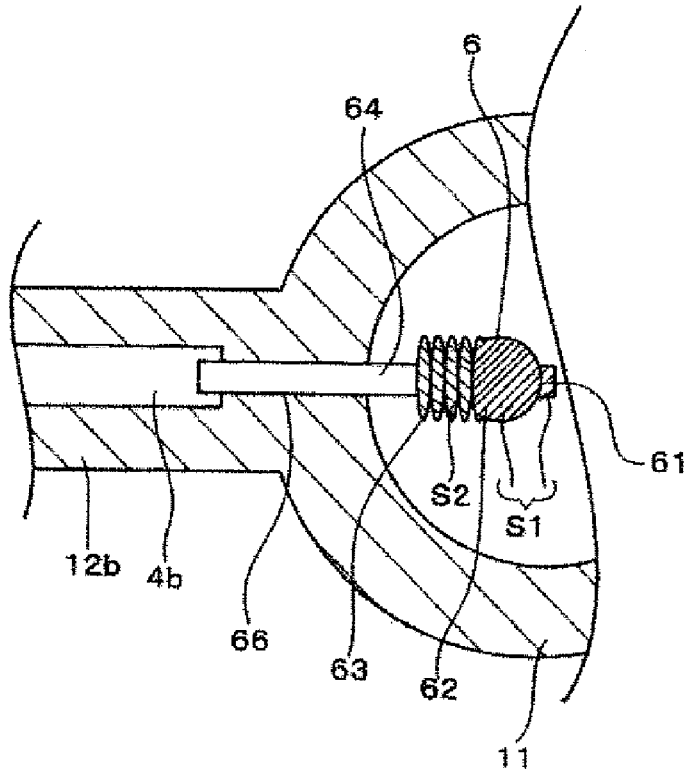
Figure 4:
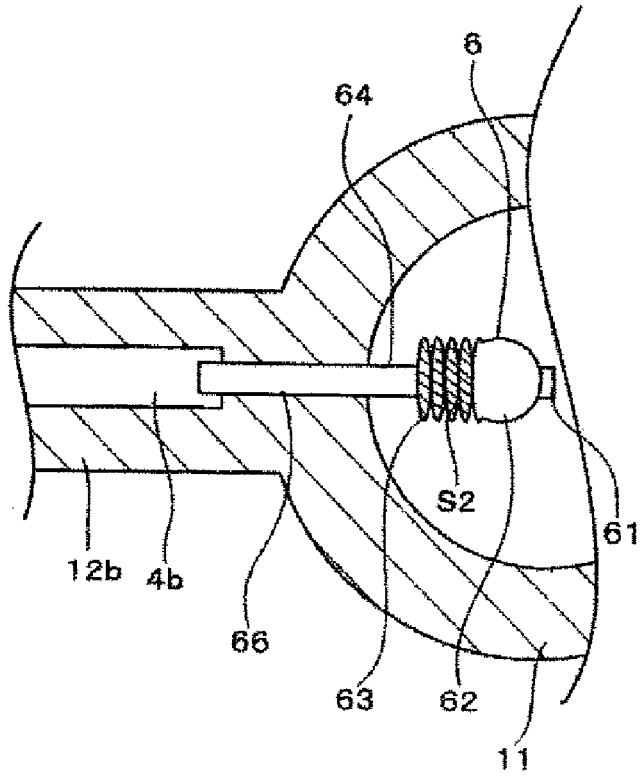

In the case of lamps of the direct current operating type, in Table 1, S is the sum of the internally projecting axial part 33 (S1) and of the starting part 32 (S2) (see, FIG. 3(*a*)) or the surface area of the element S2 of the starting part 32 (see, FIG. 3*b*). In the case of lamps of the alternating current operation type in Table 1, S is the sum of the part 62 with the larger diameter including the projection 61 (S1) and of the starting part 63 (S2) (see, FIG. 4*a*) or the surface area of the element of the starting part 63 (S2) (see, FIG. 4*b*).

In FIG. 3(*a*), a gap of at most 300 μm is formed between the section 35 of the axial part 31 covered by the hermetically sealed portion 12*b*, and the silica glass comprising the hermetically sealed portion 12*b*, as was described above. Likewise, in FIG. 4(*a*) a gap of at most 300 μm is formed between the section 66 of the axial part 64 covered by the hermetically sealed portion 12*b* and the silica glass comprising the hermetically sealed portion 12*b*, as was described above. These gaps are not contained in the area S. In Table 1, A is the concentration of the electron emission material in the parts shown in FIGS. 3(*a*) & 3(*b*) and 4(*a*) & 4(*b*).

With regard to FIGS. 3(*a*) & 3(*b*) and 4(*a*) & 4(*b*), it has to be noted that the lamps are shown in a cross-sectional view with the parts containing the electron emission material indicated by hatching. The hatching only serves the purpose of showing which parts of the electrodes are provided with the electron emission material. However, the area of the respective hatched part does not correspond to the surface area S which is the basis for calculation the amount of electron emission material according to the formula S/A. For this purpose, the outside surface area of the hatched parts, i.e., the area facing the emission space, has to be taken.

The test results shown in Table 1 confirmed that the lamp service life is prolonged when the numerical value of S/A is within the range from 1 to $1\times10^4$ when using yttrium and lanthanum as the electron emission material. On the other hand, it was confirmed that the lamp service life is shortened or not prolonged when the numerical value of S/A is outside of the above described range. It can be imagined that the reason for this is the following.

Because an electron emission material of yttrium or lanthanum is contained, the work function of the cathode 3 decreases more than in the case in which the cathode is formed solely of tungsten. This reduces the starting voltage which is needed to produce the glow discharge. Moreover, the relation between the surface area S in the part containing the electron emission material and the concentration A of the electron emission material in this part is fixed to be optimum. It is imagined that spraying of tungsten from the cathode 3 has been suppressed in this way.

On the other hand, the spraying of tungsten from the cathode 3 cannot be suppressed when the numerical value of S/A is outside the above described range. It is imagined that, in this way, the lamp service life has not been prolonged, or has even been shortened. Specifically, it can be imagined that the action of reducing the starting voltage which is needed to produce the glow discharge was not adequate in the case in which the numerical value of S/A is larger than in the above described range, since the content of the electron emission material with respect to the cathode 3 is too small. It can be imagined that the halogen cycle was hindered by the spraying of the electron emission material present in a great excess into the arc tube 1 in the case in which the numerical value of S/A is less than in the above described range, since the content of electron emission material with respect to the cathode 3 is too great.

Furthermore, the results summarized in Table 1 confirmed that the lamp service life, in the case (for exemplary embodiments 3, 5, 6, 7, 10, 13, 14, 15, 18 and 20) in which the electron emission material was contained only in the starting part 32, can be prolonged more than in the case (for exemplary embodiments 4, 8, 9, 11, 12, 16, 17, 19, 21 and 22) in which the electron emission material was contained both in the axial part 31 and also in the starting part 32. It can be imagined that the reason for this is the following.

Since the work function of the starting part 32 as compared to the work function of the axial part 31 is reduced, the starting voltage necessary to produce the glow discharge can be kept low. Furthermore, the heat capacity of the starting part 32 can be reduced by the coil shape of the starting part 32, and moreover, the temperature of the starting part 32 can be quickly raised because, in this way, the discharge is more frequently concentrated on the gap between the pitches of the coil. In this way, the interval during which the glow discharge forms can be greatly shortened, and a prompt transition of the discharge starting point to the tip of the cathode 3, and thus, a transition to a thermal arc discharge can be carried out. Therefore, the disadvantage of spraying of the tungsten comprising the cathode which occurs mainly in a glow discharge can be advantageously eliminated as a result of the ion sputtering and thermal shocks applied to the cathode.

Furthermore, blackening on the inside wall of the arc tube 1 by contact of the discharge with the inside wall of the arc tube 1 never occurs due to the fact that the starting point of the glow discharge constitutes the starting part 32 located in the vicinity of the tip of the axial part 31, in contrast to the case in which the starting point of the discharge is located in the vicinity of the side of the base part of the axial part 31.

Table 1 shows the test result in the case of using yttrium and lanthanum as the electron emission material. However, the same result can be obtained in the case of using a different electron emission material with a lower work function than tungsten, such as for example cerium, barium, strontium, hafnium and zirconium or the like.

(Process for Measuring the Area and the Concentration)

A process for measuring the surface area S ($mm^2$) of the projecting parts (34, 65) which is to be established in accordance with the invention and a process for measuring the concentration A (% by weight) of the electron emission material which is to be established in accordance with the invention in the projecting parts (34, 65) are described below.

(Surface Area S)

(1) The part in which no silica glass adheres is designated the projecting part by visual inspection of the electrodes. When visual inspection is difficult, the boundary between the projecting part and the part which is embedded in the hermetically sealed part is fixed by a projection apparatus, an optical microscope, SEM or the like.
(2) The projecting part is cut off the electrode.
(3) The surface area ($mm^2$) is computed using the cut-off projection part based on dimensions.

(Concentration A)

(1) The projecting part is cut off in the same manner as in determining the surface area.
(2) To eliminate impurities the electron surface is cleaned with a HCl solution.
(3) The weight of the projecting part after etching is measured with a mechanical or electronic balance.
(4) The projecting part after etching is dissolved in a $HNO_3+H_2O_2$ solution. The concentration of the electron emission material contained in this solution is measured by an induction coupling-high frequency plasma emission spectrochemical analysis (ICP-emission spectrochemical analysis), on the basis of which conversion into weight takes place.

(5) By dividing the weight value obtained in (4) by the weight value obtained in (3), the concentration (% by weight) of the electron emission material in the projection part is computed.

What we claim is:

1. Ultra-high pressure mercury lamp, comprising:

an arc tube, a pair of opposed electrodes opposite in the arc tube, and at least 0.15 $mg/mm^3$ mercury in the arc tube as an emission material, wherein at least one of the electrodes has an axial part which is made essentially of tungsten and a starting aid part which is made essentially of tungsten, wherein at least one of the axial part and the starting aid part comprises an electron emission material with a smaller electron affinity than tungsten such that the value of S/A in $mm^2/\%$ by weight is in the range $1.9\times10^1 \leqq S/A \leqq 1\times10^4$, where S in $mm^2$ is the area of a region of the electrodes projecting into the arc tube that contains the electron emission material and A in % by weight is the concentration of the electron emission material in said region.

2. Ultra-high pressure mercury lamp as claimed in claim 1, wherein at least one of the electrodes has a part with a larger diameter.

3. Ultra-high pressure mercury lamp as claimed in claim 2, wherein the part with the larger diameter has the electron emission material.

4. Ultra-high pressure mercury lamp as claimed in claim 1, wherein only the starting aid part contains the electron emission material.

5. Ultra-high pressure mercury lamp as claimed in claim 1, wherein the electron emission material contains at least one of the elements yttrium, lanthanum, cerium, barium, strontium, hafnium and zirconium.

6. Ultra-high pressure mercury lamp as claimed in claim 1, wherein the starting aid part is coil-shaped.

7. Ultra-high pressure mercury lamp as claimed in claim 2, wherein only the starting aid part contains the electron emission material.

8. Ultra-high pressure mercury lamp as claimed in claim 7, wherein the electron emission material contains at least one of the elements yttrium, lanthanum, cerium, barium, strontium, hafnium and zirconium.

9. Ultra-high pressure mercury lamp as claimed in claim 8, wherein the starting aid part is coil-shaped.

10. Ultra-high pressure mercury lamp as claimed in claim 3, wherein the electron emission material contains at least one of the elements yttrium, lanthanum, cerium, barium, strontium, hafnium and zirconium.

* * * * *